US010624803B2

(12) United States Patent
Parker et al.

(10) Patent No.: US 10,624,803 B2
(45) Date of Patent: Apr. 21, 2020

(54) TILTING MANUAL WHEELCHAIR

(71) Applicant: IdeaShare Designs LLC, Dover, NH (US)

(72) Inventors: Sharon Parker, Dover, NH (US); Glenn Shwaery, North Hampton, NH (US)

(73) Assignee: Ideashare Designs LLC, Dover, NH (US)

( * ) Notice: Subject to any disclaimer, the term of this patent is extended or adjusted under 35 U.S.C. 154(b) by 0 days.

(21) Appl. No.: 16/180,398

(22) Filed: Nov. 5, 2018

(65) Prior Publication Data

US 2019/0167498 A1 Jun. 6, 2019

Related U.S. Application Data

(60) Provisional application No. 62/708,082, filed on Dec. 1, 2017.

(51) Int. Cl.

| | |
|---|---|
| ***A61G 5/10*** | (2006.01) |
| ***A61G 5/12*** | (2006.01) |
| ***A61G 5/08*** | (2006.01) |

(52) U.S. Cl.

CPC ..... *A61G 5/1075* (2013.01); *A61G 5/08* (2013.01); *A61G 5/1091* (2016.11); *A61G 5/122* (2016.11); *A61G 5/1054* (2016.11)

(58) Field of Classification Search

CPC .... A61G 5/1075; A61G 5/122; A61G 5/1091; A61G 5/08; A61G 5/1054

See application file for complete search history.

(56) References Cited

U.S. PATENT DOCUMENTS

| | | | | |
|---|---|---|---|---|
| 4,655,471 | A | 4/1987 | Peek | |
| 4,949,408 | A | 8/1990 | Trkla | |
| 5,035,467 | A | 7/1991 | Axelson et al. | |
| 5,102,195 | A | 4/1992 | Axelson et al. | |
| 5,228,747 | A | 7/1993 | Greene | |
| 5,556,168 | A | 9/1996 | Dinsmoor, III et al. | |
| 5,727,843 | A | 3/1998 | LaTrace | |
| 5,971,482 | A | 10/1999 | Goertzen et al. | |
| 6,003,891 | A | 12/1999 | Broadhead | |
| 6,032,975 | A | 3/2000 | Hanson et al. | |
| 6,086,086 | A | 7/2000 | Hanson et al. | |
| 6,113,189 | A * | 9/2000 | Bennett | A61G 5/1067 297/183.7 |
| 6,126,186 | A | 10/2000 | Mascari | |
| 6,158,810 | A | 12/2000 | Galloway | |
| 6,206,393 | B1 | 3/2001 | Mascari et al. | |
| 6,257,609 | B1 | 7/2001 | O'Neill, Sr. | |
| 6,296,265 | B1 | 10/2001 | Lovins | |
| 6,338,496 | B1 | 1/2002 | O'Neill, Sr. | |
| 6,409,265 | B1 | 6/2002 | Koerlin et al. | |
| 6,799,770 | B2 | 10/2004 | Patrick et al. | |
| 7,007,965 | B2 * | 3/2006 | Bernatsky | A61G 5/12 280/304.1 |

(Continued)

*Primary Examiner* — Jacob B Meyer

(74) *Attorney, Agent, or Firm* — Pierce Atwood LLP; Kevin M. Farrell

(57) ABSTRACT

Disclosed is a manual wheelchair having a rotating seating area thereby providing a gradation of seating options between an upright and a tilted position. The rotation of the seating area of the disclosed wheelchair from an upright to a tilted position is independent of the position of provided push handles.

25 Claims, 6 Drawing Sheets

(56) References Cited

U.S. PATENT DOCUMENTS 7,306,251 B2 12/2007 Bright et al.
7,832,744 B2 11/2010 Chen et al.
7,905,504 B2 3/2011 Suddaby et al.
8,132,823 B2 * 3/2012 Balcom ..... A61G 5/1075 280/250.1
8,186,695 B2 5/2012 Moller
8,201,846 B2 6/2012 Yu et al.
8,235,407 B2 * 8/2012 Cerreto ..... A61G 5/1075 280/250.1
8,322,741 B2 12/2012 Laslo et al.
8,382,127 B2 2/2013 Longenecker et al.
8,474,848 B2 * 7/2013 Bernatsky ..... A61G 5/1062 280/250.1
8,646,795 B2 2/2014 Cerreto
8,770,665 B2 7/2014 Darling
8,944,454 B2 * 2/2015 Blauch ..... A61G 5/1075 280/304.1
8,985,618 B2 * 3/2015 Perk ..... A61G 5/02 280/250.1
9,010,787 B2 * 4/2015 Slagerman ..... A61G 5/1075 280/250.1
9,060,910 B2 6/2015 Cerreto
9,408,763 B2 * 8/2016 Purdue ..... A61G 5/1075
9,987,179 B2 * 6/2018 Melgarejo ..... A61G 5/1075
10,238,556 B1 * 3/2019 Slagerman ..... A61G 5/1059
2004/0188979 A1 * 9/2004 Bernatsky ..... A61G 5/12 280/304.1
2005/0116440 A1 * 6/2005 Bernatsky ..... A61G 5/1062 280/250.1
2008/0054596 A1 * 3/2008 Johanson ..... A61G 5/06 280/304.1
2010/0156065 A1 * 6/2010 Cerreto ..... A61G 5/1067 280/281.1
2014/0246841 A1 * 9/2014 Slagerman ..... A61G 5/1075 280/220
2014/0327231 A1 * 11/2014 Perk ..... A61G 5/02 280/647
2015/0115567 A1 * 4/2015 Blauch ..... A61G 5/1075 280/250.1
2015/0137548 A1 * 5/2015 Purdue ..... A61G 5/1075 296/65.08
2017/0273840 A1 * 9/2017 Melgarejo ..... A61G 5/1075
2018/0325758 A1 * 11/2018 Melgarejo ..... A61G 5/1075
2019/0167498 A1 * 6/2019 Parker ..... A61G 5/1075

* cited by examiner

TILTING MANUAL WHEELCHAIR

BACKGROUND OF THE INVENTION

For many, the wheelchair is the essential means of mobility and permits the occupant to perform common activities that would otherwise be difficult, if not impossible, such as navigating about one's own home, tending to outdoor chores or pleasures, attending public gatherings, shopping at a physical store location, joining family and friends, and simply escaping the confines of one's own home. Those with extreme disability or compromised motor function typically require substantial assistance. Thus, the wheelchair serves as the principal enabler of independent or assisted mobility depending on the degree of disability, permanent or temporary. Whereas the wheelchair has traditionally been viewed as a device that imparts limits or boundaries to the occupant, recent advances in wheelchair design, materials and technology coupled with improved accessibility standards and progressive attitudes regarding wheelchair access have elevated the wheelchair as a tool that facilitates health, personal enjoyment and a degree of independence and freedom.

In most cases, physicians and other clinicians direct their patients to engage in the use of wheelchairs for daily mobility in an effort to improve the physical, mental and social activity that most often leads to an improvement in overall well-being. Based on the patient's range of physical abilities, the emphasis on wheelchair use should be driven by the combination of independence and safety of the wheelchair occupant. The features of any particular wheelchair ideally match the needs driven by the daily activities of the patient inside and/or outside of the home. This latter consideration is where most wheelchairs fall short in their promise to deliver independence and mobility, when the tandem of wheelchair and occupant venture outside the controlled environment of the home, nursing care unit or similar venue, and move outside into the neighborhood or surrounding community. It is here where a caregiver is often required to negotiate the challenges of the outdoor or unfamiliar environment or terrain. Prior and ongoing efforts have attempted to develop adaptive wheelchairs that adjust to both the wheelchair occupant and the caretaker, who is often a spouse or relative who may be elderly, has physical limitations of their own, or be of a stature where "one size doesn't fit all". The ease and simplicity with which a wheelchair can be adjusted to keep the occupant both comfortably and safely seated during this process of reconfiguration has yet to be satisfactorily addressed at a price point that most consumers or insurance carriers are willing or able to pay. In addition, rarely are the ergonomics addressed from the position of the caretaker. When used under demanding environments or in repetitive, long-term caregiving regardless of the environment, it may be the caregiver behind the wheelchair who encounters the greatest risk for injury or stress to joints and muscles due to poorly designed or statically positioned features characteristic of most wheelchairs.

Most affordable, current manual wheelchairs have a stationary 90-degree angle chair. Most wheelchair occupants have a difficult time or express discomfort of the spine and lower back when sustaining that position for more than 30 minutes. Safety is also an issue when seated at the 90-degree angle because the start and stop motion often jars the occupant making them feel like they are going to fall out of the front of the wheelchair. Other, more expensive wheelchair models that recline do so in a way that only the back of the chair pivots or tilts backwards, but the seat remains stationary, so the occupant tends to slide toward the front of the seat. Some customized, very expensive models have a sledding or hinge mechanism that tilts both the back and seat of the chair as a unit but due to the additional framing, hardware and design, these chairs are heavy and beyond the economic reach of most individuals or families looking to purchase or lease a wheelchair. In addition, when current manual wheelchairs are tilted, the handles, which are attached to the seat back frame, are lowered to a position that renders them useless or at best, cumbersome to use for the caregiver.

A wheelchair which affords the ability to safely and stably rotate the seating area from an upright to a more tilted position while maintaining the angle between the seat and backrest, and while providing for ergonomically correct handle positions whether the seating area is upright or tilted, would represent an important advance in the art.

SUMMARY OF THE INVENTION

According to one aspect of the invention, a manual wheelchair for the transport of an individual in a seated position is provided, including: a frame comprising a first external frame element and a second external frame element; a first front and a first rear wheel rotatably coupled to the first external frame element, and a second front and a second rear wheel rotatably coupled to the second external frame element; a first push handle coupled to the first external frame element, and a second push handle coupled to the second external frame element, each of the first and second push handles useful for an aide to push or pull the wheelchair; a seating area comprising a backrest and a seat formed between a first internal frame element and a second internal frame element, each of the first and second internal frame elements comprising a rigid element bent or formed with a substantially identical fixed angle or curve defining a transition between the seat and the backrest, wherein the first internal frame element further comprises a first rotational coupling between the first internal frame element and the first external frame element, and wherein the second internal frame element further comprises a second rotational coupling between the second internal frame element and the second external frame element, the first and second rotational couplings enabling rotation of the seating area about an axis defined by the first and second rotational couplings, the rotation of the seating area being independent of the position of the plurality of push handles; and a means for locking the rotation of the seating area about the axis defined by the first and second rotational couplings to provide the individual with a gradation of seating options between an upright position and a tilted position. In some embodiments the manual wheelchair frame is foldable. In other embodiments the first and second rotational couplings comprises a lug or shaft. In some embodiments the backrest and the seat are formed from a flexible material stretched between the first internal frame element and the second internal frame element when the chair is in an unfolded state.

In some embodiments the manual wheelchair includes an arcuate guide element, the arcuate guide element being coupled to either the first external frame element or to the second external frame element, wherein the arcuate guide element engages a guide follower, the guide follower being coupled to the first internal frame element if the arcuate guide elements is coupled to the first external frame element, or the guide follower being coupled to the second internal frame element if the arcuate guide elements is coupled to the second external frame element. In certain embodiments of this paragraph the manual wheelchair includes at least a second arcuate guide element configured to engage a second guide follower thereby providing additional stability. In other embodiments of this paragraph the second arcuate guide element is coupled to an element selected from the group consisting of the first external frame element, the second external frame element, the first internal frame element and the second internal frame element. In some embodiments of this paragraph the guide follower is coupled to the backrest-defining portion of the first internal frame element. In other of this paragraph embodiments the second guide follower is coupled to a backrest-defining portion of the second internal frame element.

In other embodiments, the manual wheelchair includes an arcuate guide element, the arcuate guide element being coupled to either the first internal frame element or to the second internal frame element, wherein the arcuate guide element engages a guide follower, the guide follower being coupled to the first external frame element if the arcuate guide elements is coupled to the first internal frame element, or the guide follower being coupled to the second external frame element if the arcuate guide elements is coupled to the second internal frame element. In some embodiment of this paragraph the manual wheelchair includes at least a second arcuate guide element configured to engage a second guide follower thereby providing additional stability. In embodiments of this paragraph the second arcuate guide element is coupled to an element selected from the group consisting of the first external frame element, the second external frame element, the first internal frame element and the second internal frame element.

In some embodiments the means for locking includes a locking plate coupled to the first or second external frame elements, the locking plate having a plurality of fixed engagement points for engaging a mechanical element attached to or engaged with the first internal frame element if the locking plate is coupled to the first external frame, or for engaging a mechanical element attached to or engaged with the second internal frame element if the locking plate is coupled to the second external frame. In other embodiments of this paragraph the fixed engagement points are selected from the group consisting of a bore or a slot. In some embodiments of this paragraph wherein the fixed engagement points are bores, the mechanical element is a fastener. In other embodiments of this paragraph where the fixed engagement points are slots, the mechanical element is an engagement rod or pin. In some embodiments of this paragraph a spring biases the mechanical element into one of the fixed engagement points. In some embodiments of this paragraph the means for locking is configured to be operable by a foot of the aide.

In other embodiments of the present invention, the means for locking comprises a locking plate coupled to the first or second internal frame element, the locking plate having a plurality of fixed engagement points for engaging a mechanical element attached to or engaged with the first external frame element if the locking plate is coupled to the first internal frame element, or for engaging a mechanical element attached to or engaged with the second external frame element if the locking plate is coupled to the second internal frame element. In some embodiments of this paragraph the fixed engagement points are selected from the group consisting of a bore or a slot. In some embodiments of this paragraph the fixed engagement points are bores and the mechanical element is a fastener. In some embodiments of this paragraph the fixed engagement points are slots and the mechanical element is an engagement rod or pin. In some embodiments of this paragraph a spring biases the mechanical element into one of the fixed engagement points. In some embodiments of this paragraph the means for locking is configured to be operable by a foot of the aide.

In some embodiments of the present invention each of the first and second push handles are coupled to a bar-style hand grip comprising an eccentrically mounted hand grip, the hand grip being rotatably mounted about an axis. In other embodiments the rotatably mounted hand grips are indexed rotatably.

DETAILED DESCRIPTION OF THE INVENTION

Figure 1:
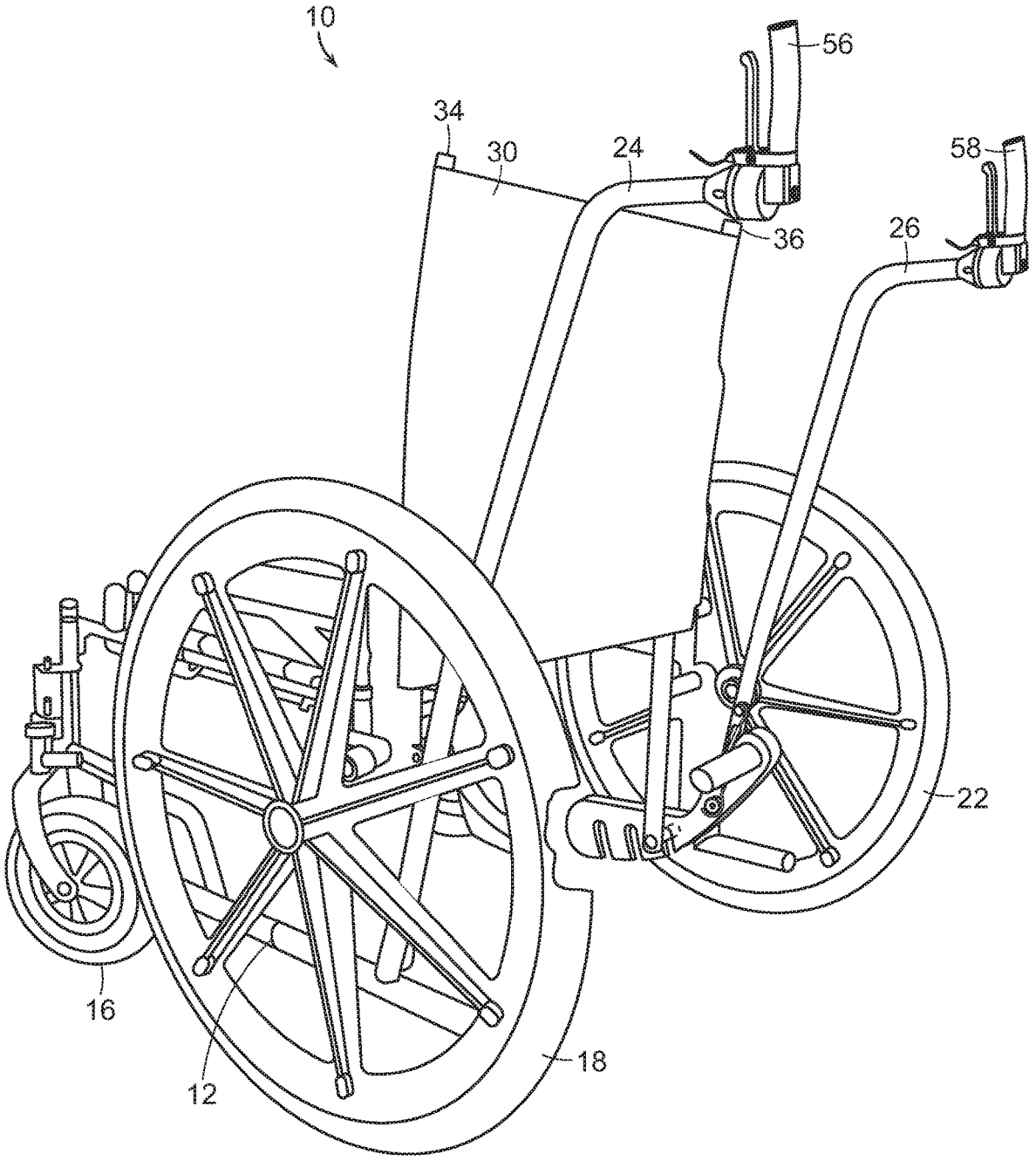
FIG. 1 is a perspective view of a wheelchair of the present invention.

The present invention relates to a manual wheelchair for the transport of an individual in a seated position. The elements of a conventional manual wheelchair are typically a frame (foldable or rigid), seat, footrests, two push handles and four wheels. Manual wheelchairs typically include a parking brake—typically a lever that pivots to bear on a rear tire. As mentioned in the Background of the Invention section, some manual wheelchairs have a seatback that pivots or reclines backwards while the seat remains stationary. This arrangement tends to promote sliding of the user along the seat into an uncomfortable "slouched" position.

As will be illustrated in the drawings and described in detail herein, the wheelchair of the present invention incorporates a "frame within a frame" design enabling a seating area, comprising a seat and a backrest, to rotate about an axis thereby providing a variety of comfortable alternative seating positions for a user.

FIG. 1 is a perspective view of the wheelchair 10 of the present invention. As mentioned, the wheelchair 10 of the present invention incorporates a "frame within a frame" design. As used herein the "frame within a frame" design includes a first and a second external frame element and a first and a second internal frame element. Frame elements are typically produced from tubular steel, although aluminum or other metal alloys can be used to take advantage of associated properties (e.g., lighter weight than tubular steel). More expensive models can incorporate more exotic framing materials such as carbon fiber.

The framing element of the wheelchair most clearly shown in FIG. 1 is first external frame element 12. Additionally, portions of the first internal frame element 34 and second internal frame element 36 are shown near the top of backrest 30. The second external frame element 14 is largely obfuscated and no reference numeral is included in FIG. 1. The various framing elements are shown more clearly in other drawings and will be discussed in turn.

Other elements of the wheelchair 10 of the present invention that are clearly visible in FIG. 1 include first rear wheel 18, second rear wheel 22 and first front wheel 16. While shown with large rear wheels and smaller front wheel, the sizing of the wheels as shown is not a requirement. For example smaller rear wheels may be combined with larger or similarly sized front wheels. Front wheels are preferably of the caster-type to enable maneuvering and steering. Any conventional tire can be used including, for example, solid rubber or urethane (flat free) tires, as well as bicycle style tires with a tubed or tubeless air bladder.

FIG. 1 also shows first push handle 24 and second push handle 26 which are useful for an aide to push or pull the wheelchair. The first push handle 24 and second push handle 26 are fitted with optional first hand grip assembly 56 and optional second hand grip assembly 58 which are discussed more fully below.

Figure 2:
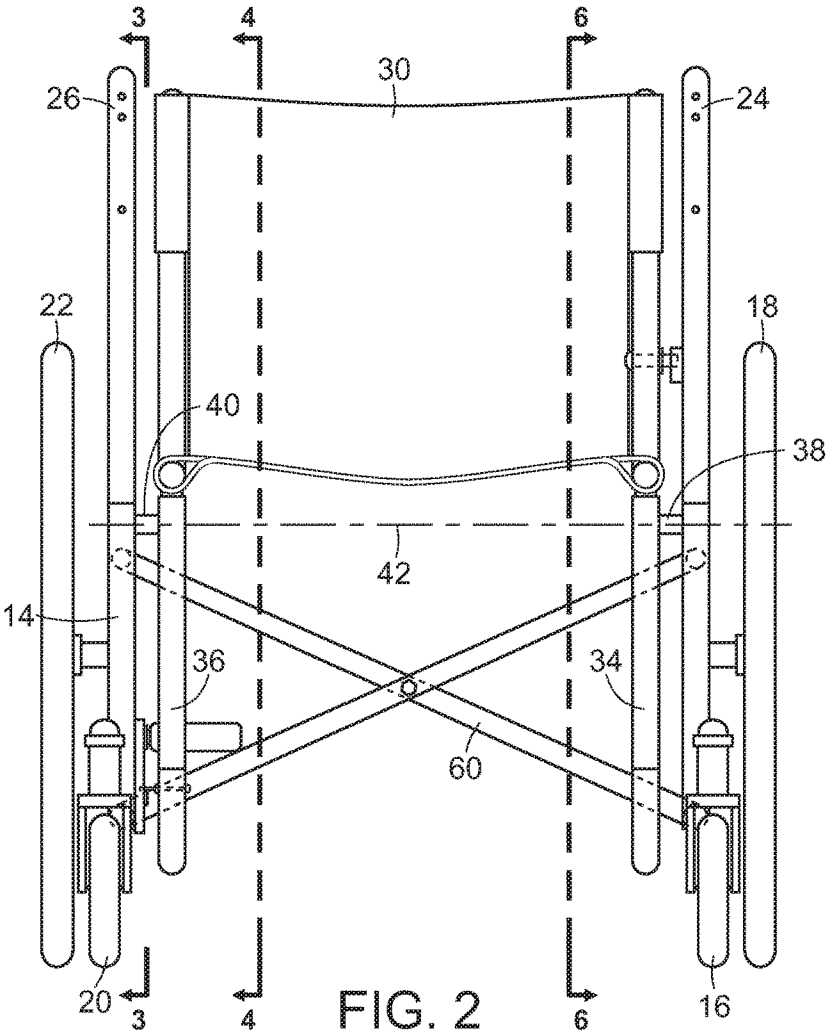
FIG. 2 is a front view of a wheelchair of the present invention.

Referring to FIG. 2, the wheelchair 10 of the present invention can be produced in a rigid or foldable embodiment. A traditional folding cross-brace 60 enables the frame elements to collapse on one another for transport, thereby bringing the sides of wheelchair 10 together. In rigid embodiments, no folding cross-brace is provided and rigid members are used to maintain a spaced-apart relationship between the first external/first internal frame components and the second external/second internal frame components. In a foldable embodiment, the backrest and seat are produced from a flexible material stretched between the first internal frame element 34 and the second external frame element 36.

Cross-sectional lines 3-3, 4-4 and 6-6 are shown in FIG. 2. The arrows point to the remainder of the part that was not sectioned. A number of the elements called out in FIG. 1 are also referenced in FIG. 2, including first front wheel 16, first rear wheel 18, second front wheel 20, second rear wheel 22, first push handle 24, second push handle 26 and backrest 30. Additional elements not previously discussed include first rotational coupling 38 and second rotational coupling 40. Together, the first and second rotational couplings (38 and 40) define an axis of rotation 42 which the internal frame elements 34 and 36 rotate about.

The first and second rotational coupling are typically comprised of a lug or shaft projecting from an internal or external frame element and engaging a bearing surface, such as a ball bearing assembly, in the counterpart frame element. Said another way, if the bearing surface is on the external frame component, then the lug or shaft projects from the internal frame surface, and vice versa. Additional discussion will be presented in connection with FIGS. 4 and 5.

Figure 3:
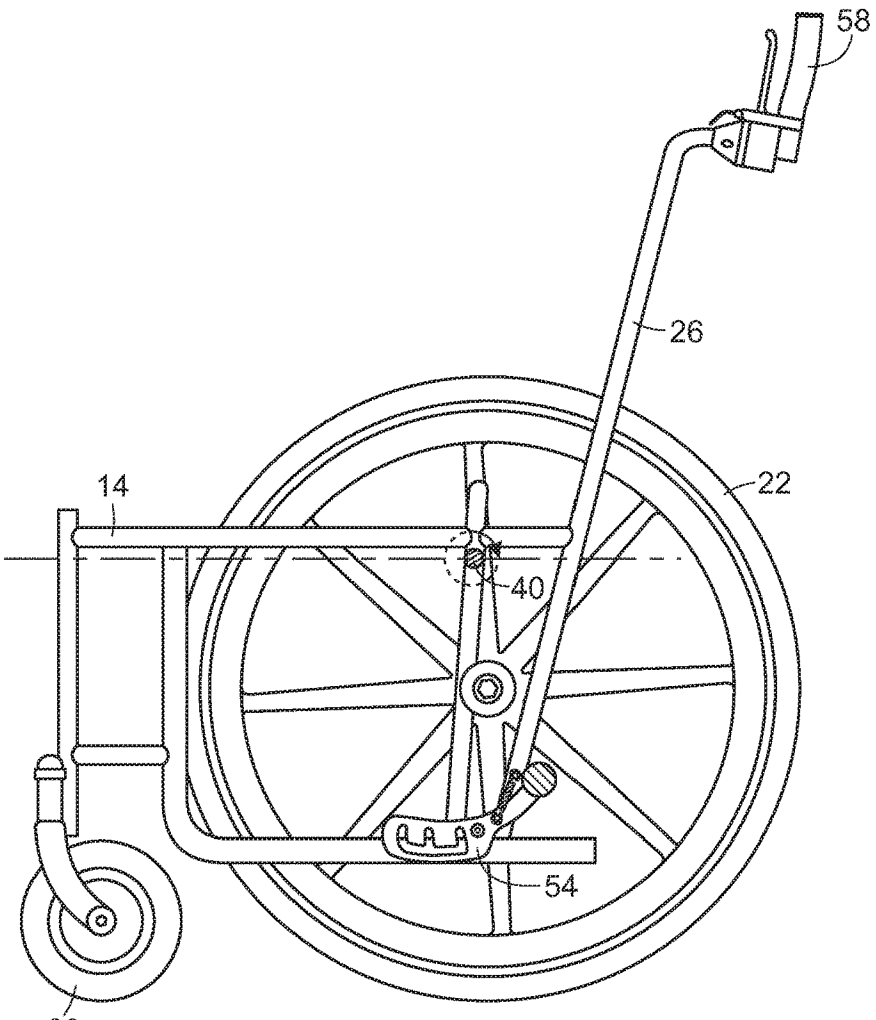
FIG. 3 is a cross-sectional view taken through line 3-3 of FIG. 2.

Referring to FIG. 3, the drawing is a view taken through line 3-3 in FIG. 2. The arrows in FIG. 2 point to the part that was not sectioned. The cross-sectional line falls between second internal frame element 36 and second external frame element 14 and shows second external frame element 14 together with previously discussed coupled elements second front wheel 20, second rear wheel 22, second handle 26 and optional second hand grip assembly 58. Other elements include an outer portion of second rotational coupling 40. Second rotational coupling 40, and its counterpart, first rotational coupling 38 (not shown) together define axis of rotation 42 (see FIG. 2). Locking plate 54 is shown and will be discussed in greater detail below.

Figure 5:
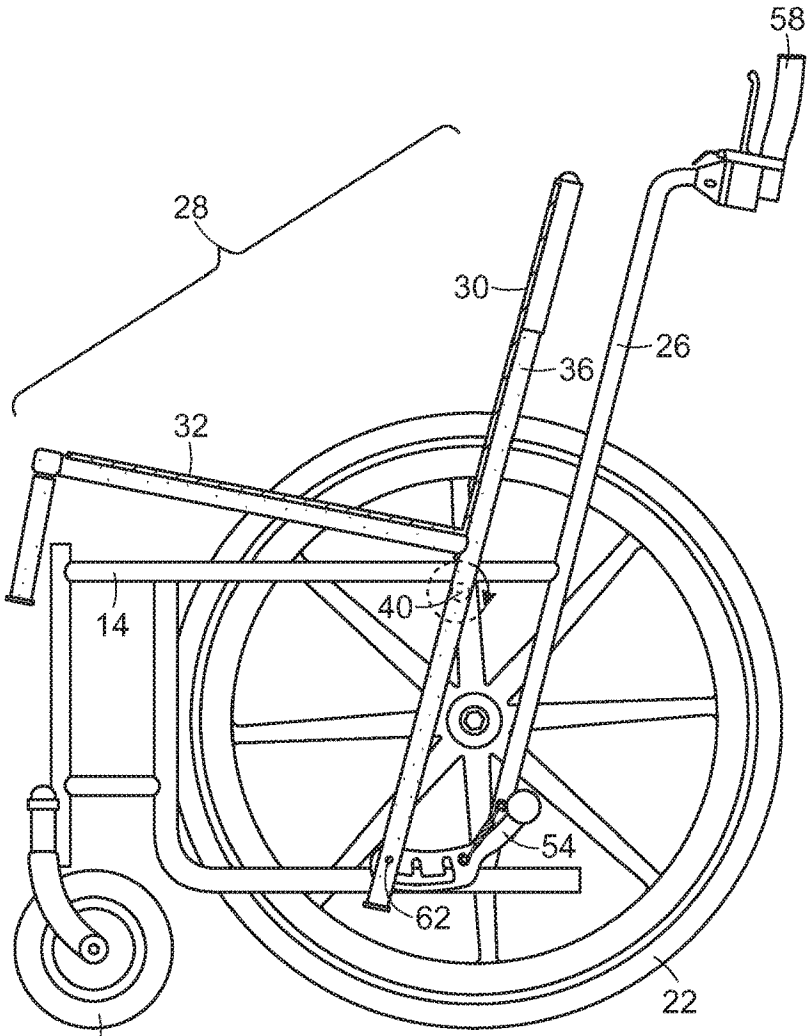
FIG. 5 is a cross-sectional view taken through line 4-4 of FIG. 2 but showing the seating area in a tilted orientation.
Figure 4:
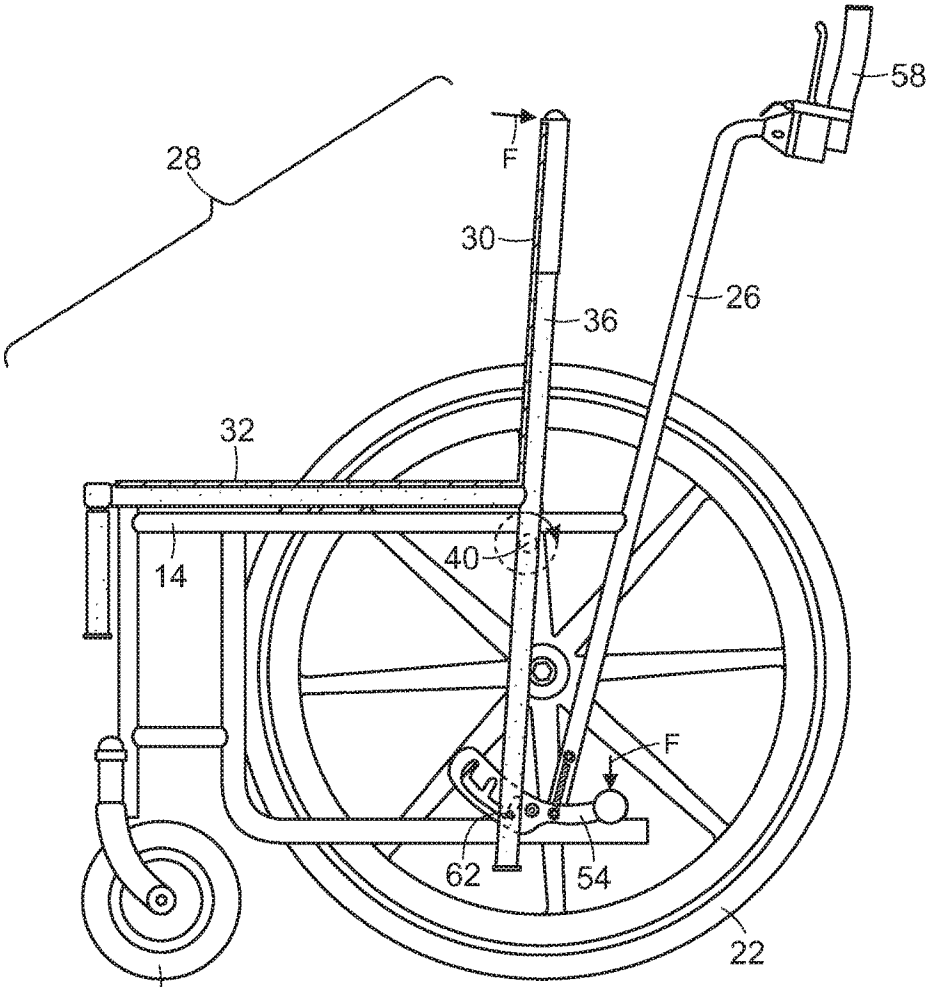
FIG. 4 is a cross-sectional view taken through line 4-4 of FIG. 2.

Referring to FIGS. 4 and 5, the drawings are a view taken through line 4-4 in FIG. 2. The arrows in FIG. 2 point to the part that was not sectioned. The cross-sectional line falls inboard of the second internal frame element 36. Elements called out in FIGS. 3 (14, 20, 22, 26, 40, 54 and 58) are again referenced in FIGS. 4 and 5. Additional elements added to FIGS. 4 and 5 include seating area 28 comprised of backrest 30 and seat 32. Second internal frame element provides framing for the backrest 30 and seat 32. In the depicted embodiment, a downward projecting portion of the second internal frame 36 is provided near the front of seat 32 for attachment of a footrest.

The first (not shown in FIGS. 4 and 5) and second 36 internal frame elements are rigid elements bent or formed with a substantially identical fixed angle or curve defining a transition between the seat 32 and the backrest 30. One of skill in the art will recognize that all framing components of the wheelchair of the present invention may be extended using known engineering principles for the purpose of increasing load bearing capability, increasing stability, providing attachment points for additional elements, and the like.

Rotation about axis 42 (see FIG. 2) is prevented by means of a locking mechanism thereby providing a gradation of seating options between an upright position and a tilted position. In embodiments, the locking means comprises a locking plate coupled to the first or second external frame elements. The locking plate is provided with a plurality of fixed engagement points for engaging a mechanical element coupled to or engaged with the first internal frame element if the locking plate is coupled to the first external frame, or for engaging a mechanical element coupled to or engaged with the second internal frame element, if the locking plate is coupled to the second external frame. As used herein, the expression "coupled" refers to attachment, directly or indirectly.

In other embodiments, the means for locking comprises a locking plate coupled to the first or second internal frame element. The locking plate is provided with a plurality of fixed engagement points for engaging a mechanical element coupled to or engaged with the first external frame element if the locking plate is coupled to the first internal frame element, or for engaging a mechanical element coupled to or engaged with the second external frame element if the locking plate is coupled to the second internal frame element.

In the means for locking embodiments described above, the fixed engagement points can be slots or bores, for example. Biasing, such as spring-biasing may be employed for the purpose of urging a mechanical element into engagement with a fixed engagement point. Any of a variety of resilient materials represent an alternative to a spring for the purpose of biasing as discussed in the preceding sentence. Such alternative will be recognized by those skilled in the art. One skilled in the art will also recognize that any mechanical means for reversibly locking the rotation of the internal frame elements and associated components may be employed and fall within the scope of the present invention.

If the fixed engagement point is a bore, the mechanical element can be a fastener such as a pin, bolt or the like. The fastener can, for example, protrude from or extend through the adjacent frame element to which the locking plate 54 is not attached. Alternatively, the fastener can protrude from or extend through an engagement plate coupled to the adjacent frame element to which the locking plate 54 is not attached.

In embodiments wherein the engagement points are slots, the adjacent frame element to which the locking plate is not attached is provided with a mechanical element for engagement such as an engagement rod or pin. The engagement rod or pin can have any cross-sectional shape, so long as it engages the slot, but round embodiments are preferred.

Again referring to FIGS. 4 and 5, locking plate 54 is coupled to external frame element. In the embodiment shown, the locking plate is configured as a spring-biased foot pedal operable by an aide. Locking plate 54 is provided with engagement points which are slots. The lower portion of second internal frame 36 extends downward from the back of the seat 32 and is provided with an engagement pin 62. FIG. 4 shows the seating area 28 positioned in an upright position with engagement pin 62 engaging the most rearward slot in locking plate 54. To position a user in a more tilted position, an aide would depress the foot lever portion on locking plate 54 to disengage engagement pin 62 thereby freeing the inner frame and associated elements to rotate back. As shown in FIG. 4, a force vector is depicted which causes the inner frame and associated element to rotate back to a more tilted position. The foot pedal on locking plate 54 is released and the spring-biased pedal engages engagement pin 62 in the most forward slot in locking plate 54.

As can be clearly seen in FIG. 5, the rotation backward of the inner frame elements and associated parts is independent of the push handle position. Thus, the mobility of the wheelchair is unaltered by the seating area position being upright or tilted.

One skilled in the art will recognize many conventional mechanical alternatives for locking plate engagement which can be implemented using no more than routine experimentation. These alternatives fall within the "locking means" recitation.

Figure 6:
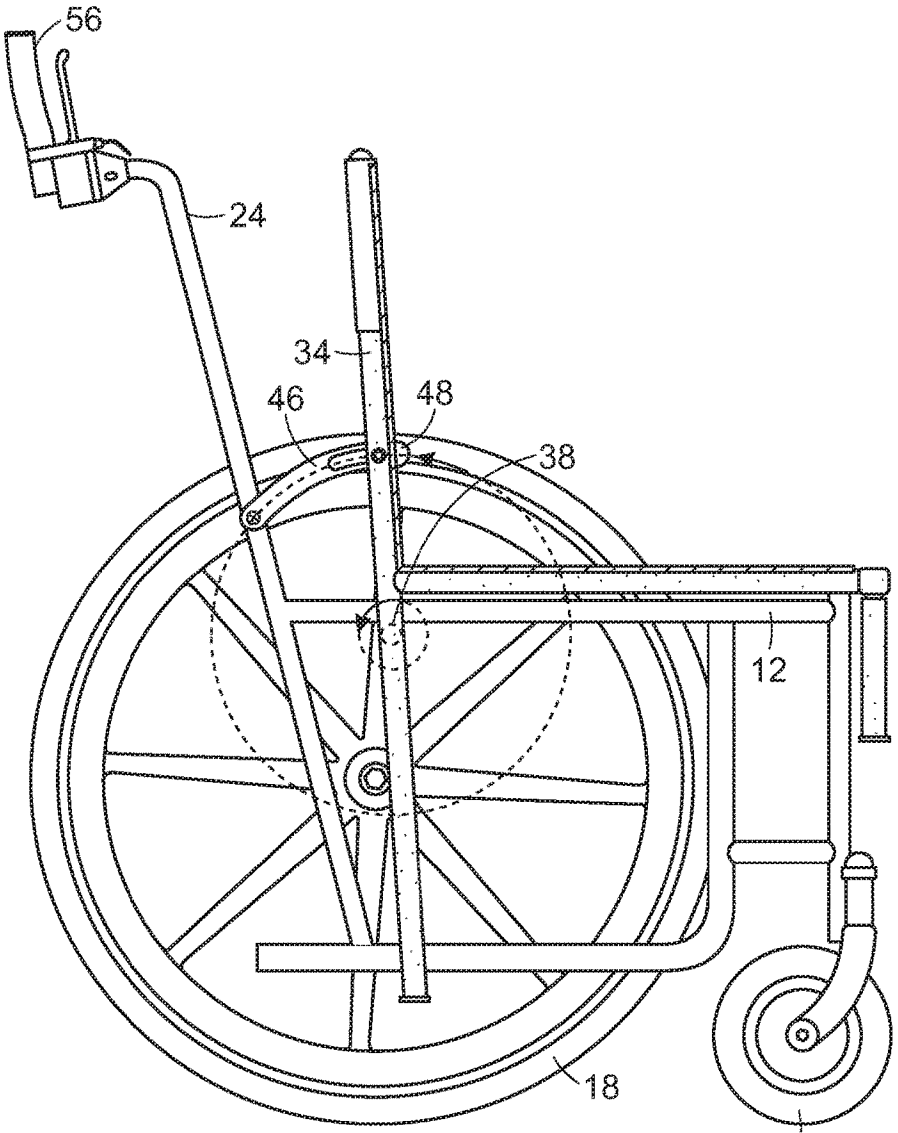
FIG. 6 is a cross-sectional view taken through line 6-6 of FIG. 2.

Referring to FIG. 6, the drawing is a view taken through line 6-6 in FIG. 2. The arrows in FIG. 2 point to the part that was not sectioned. The cross-sectional line falls inboard of the first external frame element 12 and the first internal frame element 34 and shows first external frame element 12 and first internal frame element 34 together with "first counterparts" to a number of "second" elements previously discussed in connection with FIGS. 4. These include, for example, first external frame element 12, first front wheel 16, first rear wheel 18, first push handle 24, first internal frame element 34, first rotational coupling 38 and first hand grip assembly 56.

Elements of FIG. 6 not shown or discussed previously include arcuate guide element 46 and guide follower 48, Arcuate guide element 46 is coupled to the first external frame 12. In the case shown the coupling is indirect through the first push handle 24. Guide follower 48 is coupled to the first internal frame element 34. More specifically, guide follower 48 is coupled to the backrest-defining portion of the first internal frame element 34. As the internal frame elements and associated components rotate backward from an upright seating position to a more tilted seating position, guider follower 48 follows a radius of the axis of rotation 42 along the slot in the arcuate guide element 46. This point of engagement during rotation provides stability in operation.

Figure 7:
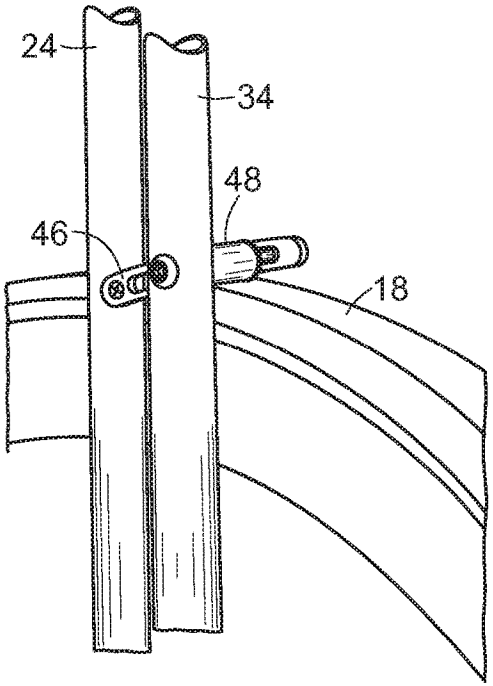
FIG. 7 is an enlarged perspective view highlighting the arcuate guide element and guide follower.

Referring to FIG. 7 a magnified view of the cross-section of FIG. 6 is shown in perspective. The magnified view shows arcuate guide element 46 in engagement with guide follower 48. Guide follower 48 is coupled to the first internal frame element 34 and arcuate guide element 46 is coupled to first external frame 12 through first push handle 24.

Speaking more generally with respect to the arcuate guide element, more than one arcuate guide element and associated follower may be provided in connection with a single wheelchair of the present invention. The inclusion of a plurality of the arcuate guide element/guide follower pairs will tend to provide additive stability in operation. The embodiment illustrated in FIGS. 6 and 7 shows the arcuate guide follower coupled (indirectly through first push handle 24) to first external frame element 12, It will be recognized that one or more arcuate guide elements can be coupled (directly or indirectly) to the second external frame element 14, to the first internal frame element 34 or to the second internal frame element 36. In the case where the arcuate guide element is coupled to the second external frame, the associated guide follower will be coupled to the second internal frame 36. In the case where the arcuate guide element is coupled to the first internal frame 34, the associated guide follower will be coupled to the first external frame 12. In the case where the arcuate guide element is coupled to the second internal frame element 36, the associated guide follower is coupled to the second external frame element 14.

Figure 8:
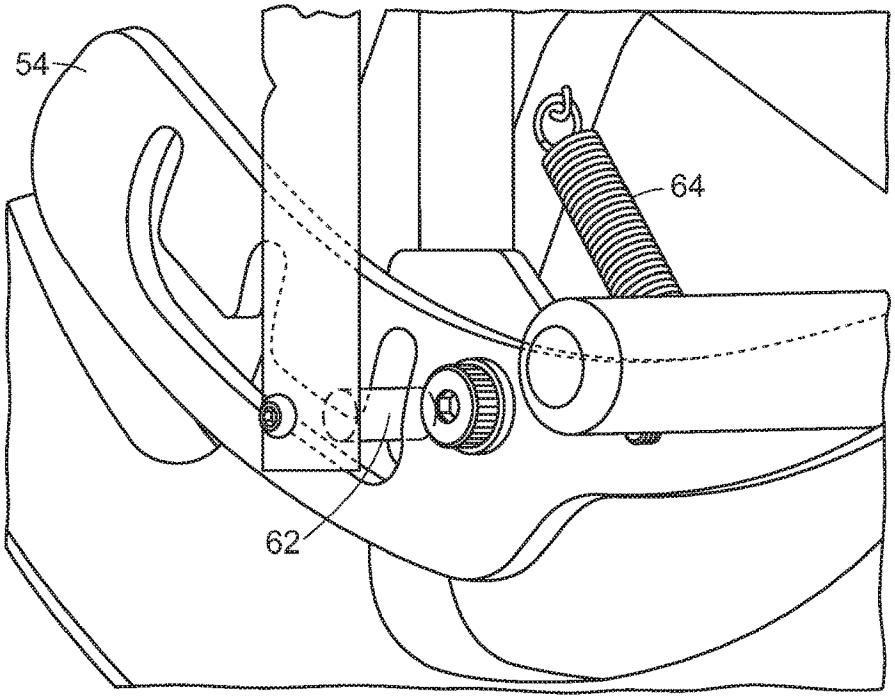
FIG. 8 is a perspective view of an embodiment of a foot operated locking plate with a slot engaging an engagement pin.

Referring to FIG. 8, shown is an embodiment of a spring-biased locking plate 54 in a foot pedal embodiment similar to that shown in FIGS. 4-6. Engagement pin 62 is featured in this drawing which shows spring 64 pulling engagement pin 62 into engagement with a slot in locking plate 54.

Figure 9:
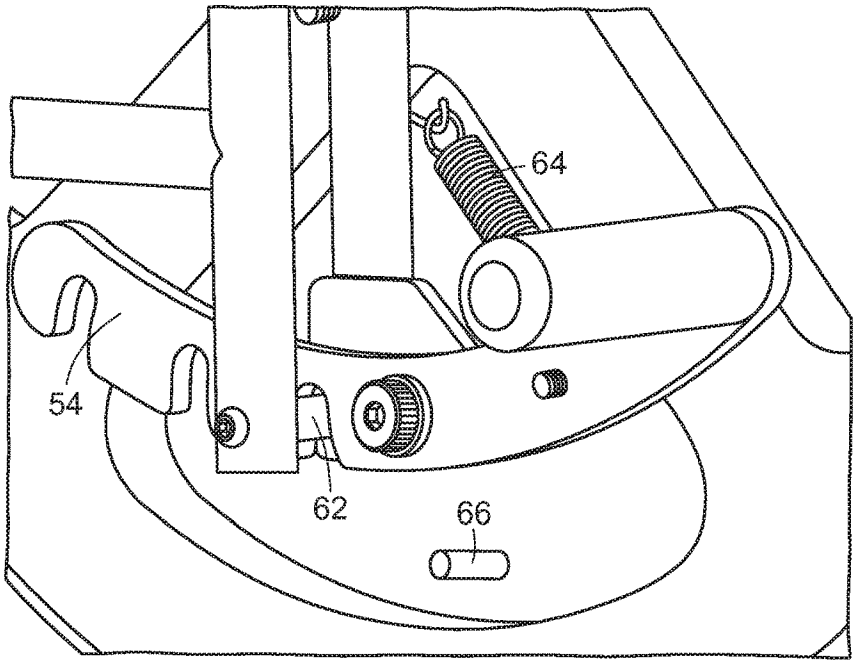
FIG. 9 is a perspective view of an embodiment of a foot operated locking plate with a slot engaging an engagement pin.

FIG. 9 shows a similar embodiment of a spring-biased locking plate 54 in a foot pedal embodiment but in this case the engagement pin 62 is not captured in a channel. Rather, the slots are open and a mechanical stop 66 is provided to limit the travel of the pedal.

Figures 10, 11:
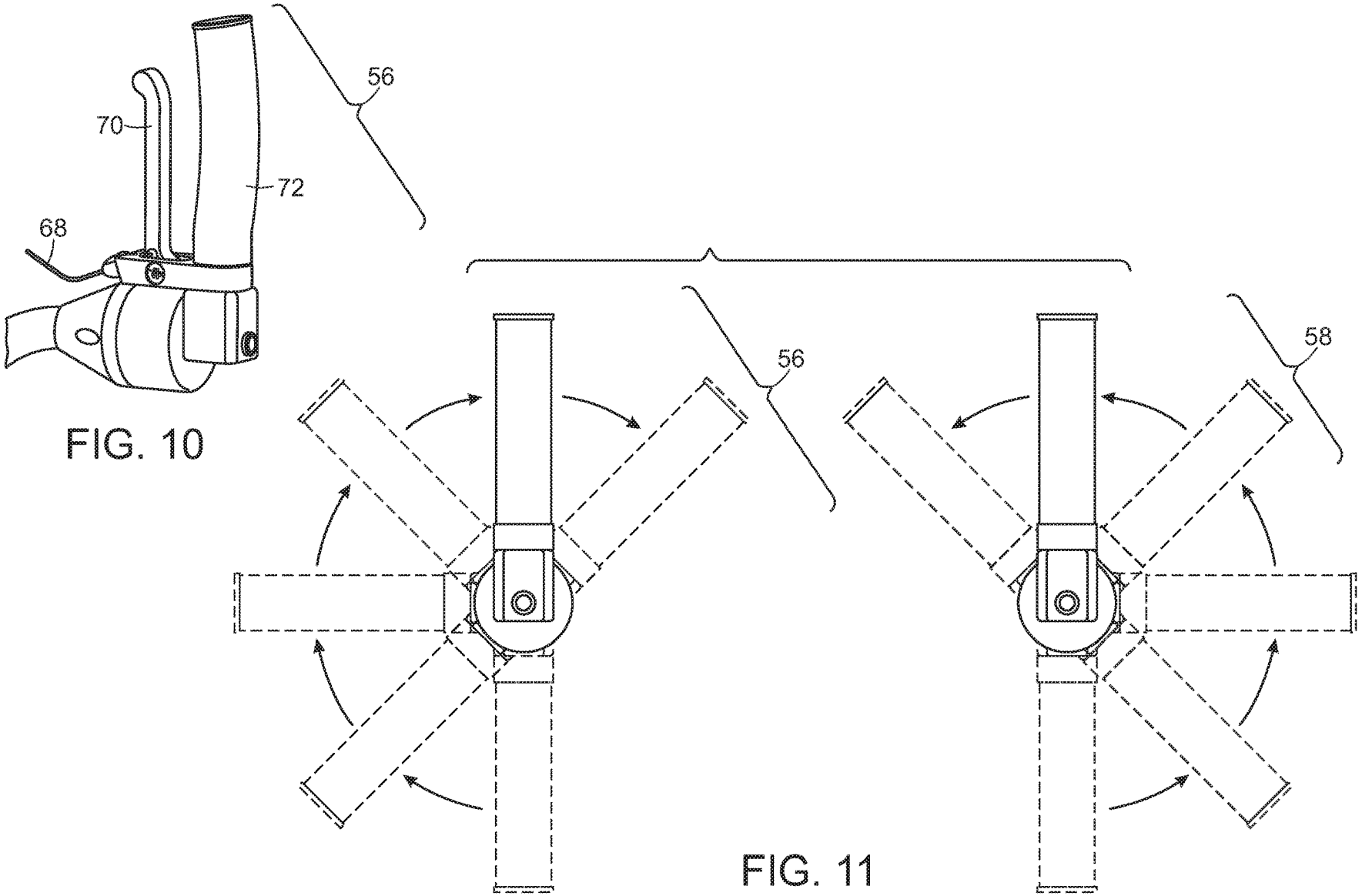
FIG. 10 is a perspective view of an optional hand grip assembly.
FIG. 11 is a front view of a first and second hand grip assembly indicating directions of rotation and alternative positions.

FIGS. 10 and 11 show detail relating to an optional handgrip assembly 56. A conventional manual wheelchair is fitted with handles that generally sweep back toward the aide pushing the wheelchair and pointing generally backward from the direction of travel. Height differences between aides can translate into markedly different levels of discomfort when pushing the wheelchair. FIG. 10 shows a first eccentrically mounted handgrip assembly including an optional lever 70 for operating a caliper brake (not shown) engaged with a wheel of the wheelchair through an operative cable connection (shown partially as 68). A handgrip 72 is shown.

FIG. 11 shows a first handgrip assembly 56 and a second handgrip assembly 58. It can be seen that the handgrips are rotatable about an axis thereby providing grip options that provide greater comfort for aides of differing stature, for example.

In embodiments, the handle position is adjustable through a series of components all linked to a push button. The push button is accessible on the front of the handle, so while grasping the handle, the aide simply extends their thumb to push the button and then rotate the handle to the desired position.

When the button is pressed, it engages a spring-loaded disk inside. This action releases the disk from a stationary pin. The disk has several holes into which the pin can slide and immobilize the disk from further rotation when the button is released (each hole represents each possible position of the handle itself). If the button is continuously pressed, the handle can rotate to any position the caregiver wishes, skipping any number of intermediate positions. If the button is pressed once and released, the handle will only rotate to the next position, popping the pin into the next adjacent hole in the disk. Once the pin is in the desired hole in the disk, the handle is now locked into the caregiver's desired ergonomic position.

The invention claimed is:

1. A manual wheelchair for the transport of an individual in a seated position, the wheelchair comprising:

a frame comprising a first external frame element and a second external frame element;

a first front and a first rear wheel rotatably coupled to the first external frame element, and a second front and a second rear wheel rotatably coupled to the second external frame element;

a first push handle coupled to the first external frame element, and a second push handle coupled to the second external frame element, each of the first and second push handles useful for an aide to push or pull the wheelchair;

a seating area comprising a backrest and a seat formed between a first internal frame element and a second internal frame element, each of the first and second internal frame elements comprising a rigid element bent or formed with a substantially identical fixed angle or curve defining a transition between the seat and the backrest, wherein the first internal frame element further comprises a first rotational coupling between the first internal frame element and the first external frame element, and wherein the second internal frame element further comprises a second rotational coupling between the second internal frame element and the second external frame element, the first and second rotational couplings enabling rotation of the seating area about an axis defined by the first and second rotational couplings, the rotation of the seating area being independent of the position of the plurality of push handles; and a means for locking the rotation of the seating area about the axis defined by the first and second rotational couplings to provide the individual with a gradation of seating options between an upright position and a tilted position.

2. The manual wheelchair of claim 1 wherein the frame is foldable.

3. The manual wheelchair of claim 2, further comprising an arcuate guide element, the arcuate guide element being coupled to either the first external frame element or to the second external frame element, wherein the arcuate guide element engages a guide follower, the guide follower being coupled to the first internal frame element if the arcuate guide elements is coupled to the first external frame element, or the guide follower being coupled to the second internal frame element if the arcuate guide elements is coupled to the second external frame element.

4. The manual wheelchair of claim 3 further comprising at least a second arcuate guide element configured to engage a second guide follower thereby providing additional stability.

5. The manual wheelchair of claim 4 wherein the second arcuate guide element is coupled to an element selected from the group consisting of the first external frame element, the second external frame element, the first internal frame element and the second internal frame element.

6. The manual wheelchair of claim 3, wherein the guide follower is coupled to the backrest-defining portion of the first internal frame element.

7. The manual wheelchair of claim 4, wherein the second guide follower is coupled to a backrest-defining portion of the second internal frame element.

8. The manual wheelchair of claim 2, further comprising an arcuate guide element, the arcuate guide element being coupled to either the first internal frame element or to the second internal frame element, wherein the arcuate guide element engages a guide follower, the guide follower being coupled to the first external frame element if the arcuate guide elements is coupled to the first internal frame element, or the guide follower being coupled to the second external frame element if the arcuate guide elements is coupled to the second internal frame element.

9. The manual wheelchair of claim 8 further comprising at least a second arcuate guide element configured to engage a second guide follower thereby providing additional stability.

10. The manual wheelchair of claim 9 wherein the second arcuate guide element is coupled to an element selected from the group consisting of the first external frame element, the second external frame element, the first internal frame element and the second internal frame element.

11. The manual wheelchair of claim 1, wherein each of the first and second rotational couplings comprises a lug or shaft.

12. The manual wheelchair of claim 1, wherein the means for locking comprises a locking plate coupled to the first or second external frame elements, the locking plate having a plurality of fixed engagement points for engaging a mechanical element attached to or engaged with the first internal frame element if the locking plate is coupled to the first external frame, or for engaging a mechanical element attached to or engaged with the second internal frame element if the locking plate is coupled to the second external frame element.

13. The manual wheelchair of claim 12 wherein the fixed engagement points are selected from the group consisting of a bore or a slot.

14. The manual wheelchair of claim 13 wherein the fixed engagement points are bores and the mechanical element is a fastener.

15. The manual wheelchair of claim 13 wherein the fixed engagement points are slots and the mechanical element is an engagement rod or pin.

16. The manual wheelchair of claim 1, wherein the means for locking comprises a locking plate coupled to the first or second internal frame element, the locking plate having a plurality of fixed engagement points for engaging a mechanical element attached to or engaged with the first external frame element if the locking plate is coupled to the first internal frame element, or for engaging a mechanical element attached to or engaged with the second external frame element if the locking plate is coupled to the second internal frame element.

17. The manual wheelchair of claim 16 wherein the fixed engagement points are selected from the group consisting of a bore or a slot.

18. The manual wheelchair of claim 17 wherein the fixed engagement points are bores and the mechanical element is a fastener.

19. The manual wheelchair of claim 16 wherein the fixed engagement points are slots and the mechanical element is an engagement rod or pin.

20. The manual wheelchair of claim 12, wherein a spring biases the mechanical element into one of the fixed engagement points.

21. The manual wheelchair of claim 16, wherein a spring biases the mechanical element into one of the fixed engagement points.

22. The manual wheelchair of claim 1, wherein the means for locking is configured to be operable by a foot of the aide.

23. The manual wheelchair of claim 2, wherein the backrest and the seat are formed from a flexible material stretched between the first internal frame element and the second internal frame element when the chair is in an unfolded state.

24. The manual wheelchair of claim 1 wherein each of the first and second push handles are coupled to a hand grip comprising an eccentrically mounted hand grip, the hand grip being rotatably mounted about an axis.

25. The manual wheelchair of claim 24 wherein the rotatably mounted hand grips are indexed rotatably.

* * * * *